United States Patent [19]

Povilaitis

[11] 4,196,325

[45] Apr. 1, 1980

[54] SUMP PUMP SWITCH

[75] Inventor: Stanley A. Povilaitis, Bristol, Conn.

[73] Assignee: Crouse-Hinds Arrow Hart Inc., Hartford, Conn.

[21] Appl. No.: 777,088

[22] Filed: Mar. 14, 1977

[51] Int. Cl.[2] ..... H01H 13/28

[52] U.S. Cl. ..... 200/67 A; 200/275

[58] Field of Search ..... 200/67 A, 67 G, 6 C, 200/6 R, 67 D, 67 DA, 67 B, 153 T, 275

[56] References Cited

U.S. PATENT DOCUMENTS

| | | | |
|---|---|---|---|
| 2,749,400 | 6/1966 | Chichester | 200/67 A |
| 3,989,915 | 11/1976 | Nishikawa | 200/67 G |
| 3,996,436 | 12/1976 | Barney | 200/67 A |

*Primary Examiner*—Christopher K. Moore

*Attorney, Agent, or Firm*—Davis, Hoxie, Faithfull & Hapgood

[57] ABSTRACT

A sump pump switch has a swingable insulating yoke carrying flexible contact strips which are pivotally connected to the yoke for relative lateral movement. The movable contacts swingably engage in notches in electric terminal members. Over-center mechanism moves the yoke and contact strips between two positions, in one of which the movable contacts engage fixed contacts. Such engagement, and disengagement, is maintained by the flexibility of the movable contact strip, in the area of dead center position of the over-center mechanism and the resiliency of the contact strips absorbs energy on switch closing movement.

24 Claims, 8 Drawing Figures

FIG.1
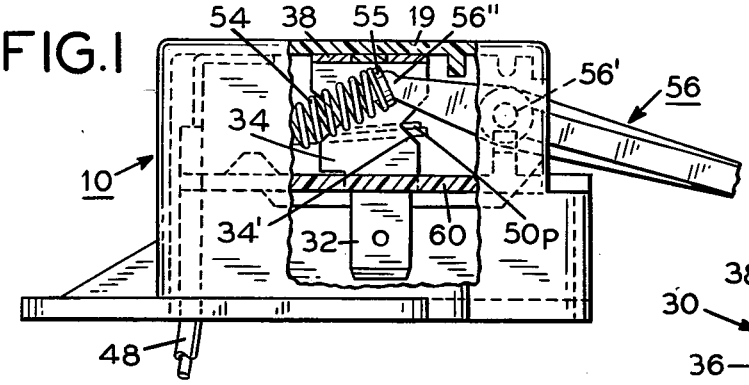
FIG.7
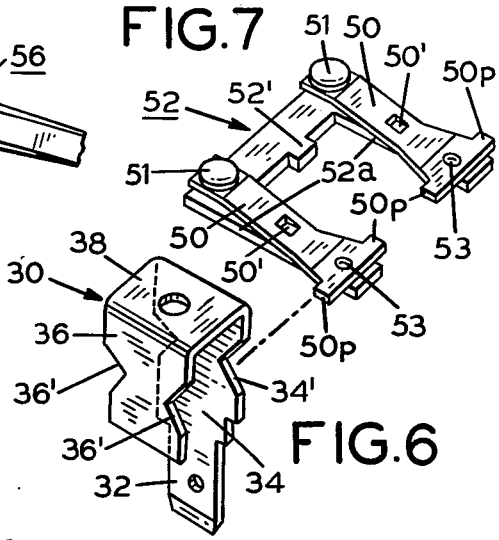
FIG.6
FIG.2
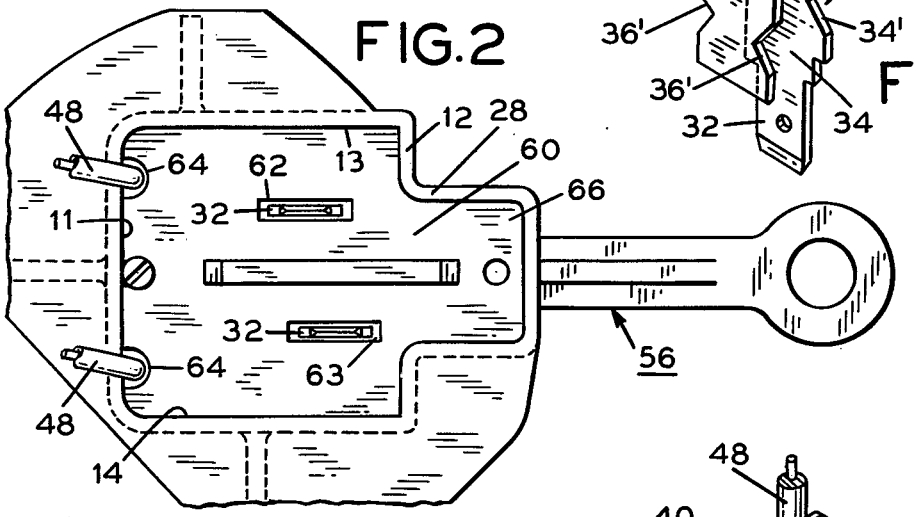
FIG.3
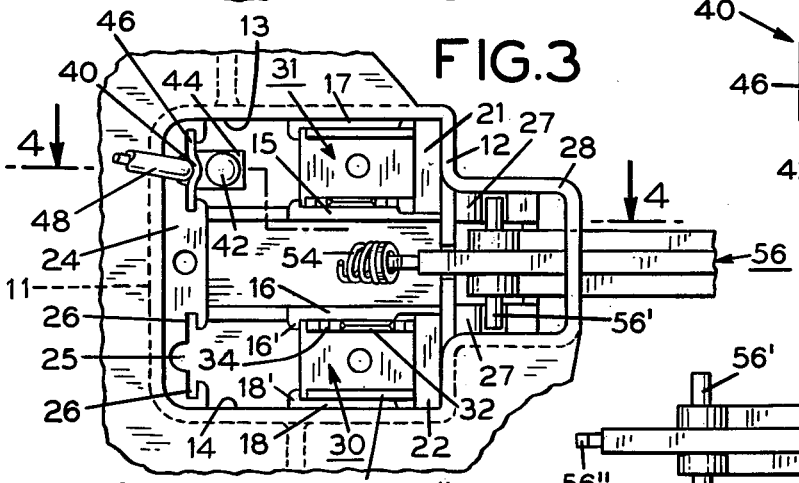
FIG.8
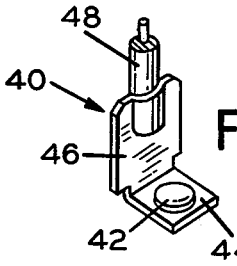
FIG.5
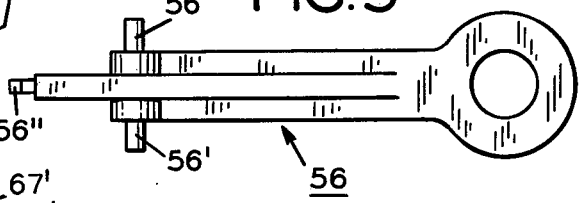
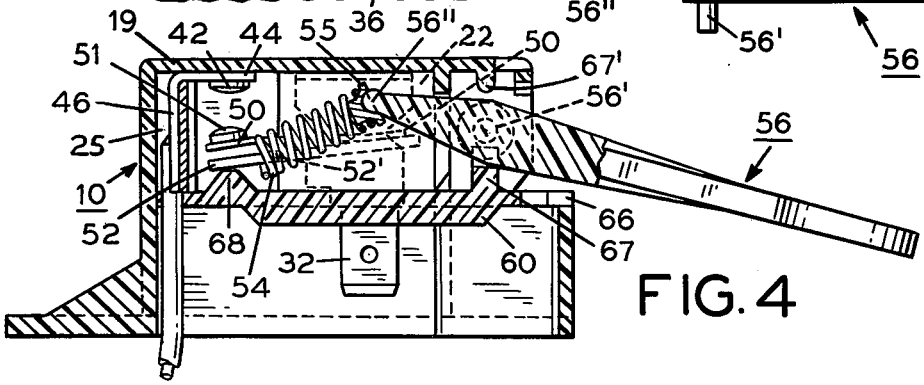
FIG.4

SUMP PUMP SWITCH

This invention relates to electric switches and more particularly to switches known commonly as sump pump switches which control the starting and stopping of electric motors which operate pumps in response to the rise and fall of the level of water or other liquid.

The rise and fall of liquid in sumps occurs at unpredictable rates which may also vary during the rise and fall. Normally, floats connected with a switch operating lever or other means, will cause the separation and engagement of contacts to connect and disconnect the pump motor. The switch opening and closing movements should occur with a snap action to minimize arcing at the contacts and thereby prolong the switch life. Snap action switches used are commonly of the over-center spring type. Whilst that type of switch gives a good quick opening and closing action when the operating lever or member moves suddenly from one position to another and even when moved relatively slowly at a regular rate, the action is not so satisfactory when, at the dead center position, there is a hesitation or a reduction in the rate of movement to almost nil. When nearing dead center, the component of force which tends to move the spring over dead center is minimum and approaches nought. Likewise, the force tending to hold the contacts closed is minimum and approaches nought. Such a condition increases the resistance at the contacts and causes heat rise. Moreover, a teetering condition can occur wherein the contacts separate slightly and reengage causing arcing which is deleterious resulting in scarring and burning of the contacts.

Further, in double pole switches it is desirable to have the break in both lines of the electric circuit occur simultaneously. This is difficult to achieve and practically impossible. Nevertheless, it is the objective which switch manufacturers try to achieve by careful adjustments and assembly techniques which are often difficult and always increase the manufacturing costs.

There have been a number of over-center type sump pump switches marketed, some single pole and some double pole. But they have suffered the disadvantages above mentioned.

Therefore, it is an object of this invention to provide a switch of the over-center spring type especially adapted for use as a sump pump switch, which requires a minimum number of parts and does not require delicate and tedious adjustments nor complicated adjustment techniques.

Another object is to provide a switch of the aforesaid type having movable contacts mounted for self adjustment.

Another object is to provide a double post switch of the aforesaid type with self-adjusting contacts which are mounted for simultaneous movement from one switch position to the other and which engage before the over-center operating means reaches its at-rest position and disengage after the said operating means passes through dead-center position. A related object is to maintain contact pressure of the movable contacts against the fixed contacts while the over-center contacts move over-center.

Other objects and advantages will appear as the invention is described in connection with the accompanying drawing.

In the drawings:

FIG. 1 is a side elevation view partly broken away of a switch embodying the invention.

FIG. 2 is a bottom view of the device of FIG. 1.

FIG. 3 is a longitudinal section view taken along line 3—3 of FIG. 2.

FIG. 4 is a view similar to FIG. 2 partly broken away with the cover plate and over-center mechanism and movable contact assembly removed.

FIG. 5 is a detail view of the switch operating lever from the device of FIGS. 1–3.

FIG. 6 is a perspective view of a terminal member from the device of FIGS. 1–4.

FIG. 7 is a perspective view of the movable contact member from the device of FIGS. 1–4.

FIG. 8 is a perspective view of the fixed contact from the device of FIGS. 1–4.

Referring to the drawings, the switch parts are mounted in a hollow housing 10 of molded insulating material having parallel vertical side walls 13, 14 and walls 11, 12, and a horizontal wall 19. Within the housing and molded integrally therewith are parallel spaced partitions 15, 16 descending halfway from the wall 19 in the mid-portion of the housing and running inwardly from end wall 12 (see FIG. 4). Formed upon the side walls 13, 14, opposite the partitions 15, 16, are flat panels 17, 18. The panels terminates a short distance from the end wall 12. In the space between the end wall and the edge of the panels are formed ledges 21, 22 descending from the wall 19 a distance less than the height of the panels.

As will hereinafter more fully appear, the partition 16, panel 18 and the vertical wall of the ledge 22 form a pocket to receive snugly a U-shaped sheet metal wire terminal member 30 which may conveniently be stamped from sheet metal. The parallel sides 34, 36 of the terminal member lie flush against the walls of the partition 16 and panel 18 while its parallel and bottom edges abut the vertical wall of the ledge 22. The opposite edges of the terminal member 30 engage parallel oppositely facing beads 16' and 18' formed on upstanding edges of the partition 16 and the panel 18, respectively, thus locating and holding the terminal member in place after insertion.

Another identical terminal member 31 is located and held in the same manner between partition 15, panel 17 and ledge 21.

The terminal members 30, 31 are identical so that they can be used interchangeably in reversed positions in the device. Each has a terminal tab such as 32 extending through a cover plate 60 as hereinafter described.

A pair of fixed contact members 40 stamped from sheet metal into L-shape (FIG. 8) with a contact button 42 on one leg 44 are located in the inner corners of the housing opposite the terminal members. The contact members are formed to be slid into place toward the floor of the housing with their side edges engaging in oppositely facing slots 26 formed in recesses 25 on opposite sides of the centerline of a block portion 24 molded within the housing at one end. For that purpose the vertical leg 40 of each fixed contact member is wider than the button carrying leg 44.

For welding or otherwise securing a pigtail wire lead 48 to the leg 46, the leg 46 is longitudinally arched at its extremity to accommodate the insulation of the wire whose end is bared and preferably welded to the back of the leg 46.

The fixed contacts are each engaged by a separate pivoted movable contact 50 mounted on a U-shaped stamped sheet insulation member 52. Movement of the yoke with a snap action is by an over-center coiled compression spring 54 one end of which is moved by a pivoted actuating lever 56 which has an end extending outside the housing 10 for connection to a float or float-controlled actuating means (not shown).

The lever 56 may be molded from insulating material with trunnions 56' at its mid-portion which seat in aligned bearing recesses 27 formed in the sidewalls of a hollow outward extension 28 of the end wall 12 of housing 10. The trunnions 56' are held in said bearing seats by a cover plate 60 as hereinafter explained.

The movable contacts are stamped into T-shape from thin sheet metal such as beryllium copper alloy or any other metal or alloy having good electrical conductivity and resiliency. On one end of each contact 50, a contact button 51 is mounted. The opposite or T-end is affixed loosely to the free ends of the yoke arms **52*a* by a single circular rivet 53, about which the contact can pivot. The leg portion of the contact is bent away slightly from the leg portion of the yoke so that it may flex toward and away from the yoke as the movable contact buttons 51 engage and disengage the fixed contact buttons 42**.

Midway along the leg of each contact 50 a tongue 50' is lanced out toward the arm **52*a*** of the yoke, for a purpose hereinafter described.

The pivotal mounting of the movable contact assembly is by means of the T-portions or lateral extensions **50*p* engaging in aligned V notches 34', 36' formed in the opposite edges of the sides 34, 36 of the terminal members 30, 31. The arms 52*a* of the insulating yoke 52 are spaced so that when assembled, each will lie between the parallel sides of one of the terminal members 30, 31, with the respective laterally extending pivot portions 50 seated edgewise in the V-bearing notches 34', 36'**.

The ability of the movable contact members to pivot about the rivets 53 enables the contact members to self-adjust as the pivots **50*p* seat in the bearing notches 34', 36', and also to self-adjust to the fixed contacts 42**. This avoids costly time-consuming and difficult adjusting of the parts during manufacture and prolongs effective operating life of the switch, as well as maintaining operating parts in proper relative locations and operating condition during the life of the switch.

The over-center spring 54 seats at one end over a positioning lug 52' formed at mid-point on the inside edge of the transverse part of the yoke 52. The opposite end of the spring engages the inner end 56" of the operating lever 56 with a dished circular washer 55 or cap member made of synthetic plastic material or other suitable material between the lever and spring. The washer, when made of plastic material, engaging the end 56" of the operating lever reduces friction and prolongs the life of the parts.

Because the rate of rise and fall of the liquid level is variable and unpredictable, there is, on numerous occasions, a gradual lessening of the component of force that tends to move the spring 54 over-center. When moving from switch-on to switch-off position, this lessening of force tends to lessen the contact pressure in switches wherein the over-center spring pressure alone is relied upon to maintain the fixed and movable contacts in engagement. Heat rise and arcing occur under such conditions, deleteriously affecting the contacts and shortening the life of the switch.

The present invention copes with this condition by the aforesaid mounting of the movable contact. The bend of the movable contact slightly away from the yoke is achieved by a bend between the T-portion and leg portion, resulting in contact engagement before the yoke 52 reaches full-on position, and also maintains contact engagement until after the yoke moves over-center toward switch-open position.

In addition, the lanced out tongue 50' provides a resilient fulcrum point for the movable contact which shortens the lever arm at the time when the component of force of the over-center spring is most strongly exerted in switch closing movement. This enables more energy to be absorbed for the same amount of over-travel of the yoke, after the initial engagement of the fixed and movable contacts. It also restricts any tendency of "contact bounce", while retaining the ability of the movable contact to remain engaged with the fixed contact when the over-center position is reached on contact-opening movement.

The mounting of two movable contacts independently on a single rigid yoke in double pole switch tends to equalize the pressure exerted by each pair of fixed and movable contacts, whilst enabling maintenance of contact engagement of each pair until dead-center is passed through by the over-center mechanism. In other words, the desideratum of the separation of contacts of both pairs simultaneously is more nearly achieved by mounting the contacts as described.

To enclose and protect the parts within the housing a cover plate 60 of insulating material is fixedly secured within the housing having the same general contour as the interior of the housing. Offset central apertures 62, 63 are provided in the cover for the terminal tabs 32 to extend through; and at one edge recesses 64 are provided for the pigtail wire leads 48. A portion 66 at one end of the cover extends into the housing extension 28 and protrudes through an opening therein so as to lie on an edge of the housing extension and be supported thereby. The opposite edge of the cover lies upon and is secured to the housing block 24.

On the inner face of the cover 60 beneath the extending portion 66 and over the trunnion portion of the operating lever 56 a transversely positioned bridging block is formed for the purpose of holding the trunnions 56' of the lever 56 in their seats 27.

At the opposite end of the cover extending inwardly therefrom at mid-position across the cover, a conical stop member 68 is formed in position to be abutted by the center of the transverse part of the yoke 52.

This conical extension provides a point support against which the yoke abuts in switch-open position.

In operation of the switch, the water or other liquid in the sump causes a float (not shown) to rise moving the operating lever up from the position of FIG. 4. This causes the switch spring to move over-center snapping the contact assembly into contact-engaging position, during which the movable contacts engage the fixed contacts before the yoke and spring reach their at rest position. An opposite action occurs when liquid level in the sump falls. When the over-center mechanism reaches dead-center, the fixed contacts remain engaged with the movable contacts due to the spring bias of the latter, thus overcoming the teetering of the movable contact and weak contact pressure. Contact disengagement does not occur until the over-center position is passed and the yoke is moving to switch-open position.

From the foregoing it will be apparent that the invention provides a switch particuarly adapted for use in controlling the electric motor of a sump pump. By making all parts of molded insulation material, except the current carrying parts and over-center spring, corrosion is avoided and economy in manufacture is achieved. Self-adjustment of the movable contacts in the movable contact assembly is achieved by the mounting of the movable contact members and the way they are pivoted for swinging action between open and closed switch position.

Modifications within the scope of the invention will occur to those skilled in the art. Therefore, the invention is not limited to the specific details of the embodiments shown and described.

I claim:

1. In an electric switch, a housing, fixed and movable contact means mounted in said housing in position for engagement and disengagement of said fixed contact means by said movable contact means, electrically conductive terminal means mounted in said housing, said movable contact means pivotally engaging and being supported swingably on said terminal means.

a movable insulation member to which said movable contact means is unitarily connected, said terminal means having two spaced parts, said movable contact means extending between said parts and having extensions extending oppositely therefrom and engaging said parts for pivotally supporting said movable contact means, said movable contact being resilient and having means bent therefrom in position to engage said insulating member as said movable and fixed contact means engage whereby said bent means enhances absorption by said movable contact means of the kinetic energy incident to switch closing movement, and over-center switch-operating means movable between two positions and engaging said insulation member for causing engagement and disengagement of said movable and fixed contact means as said operating means is moved to and fro over-center.

2. In an electric switch, a housing, fixed and movable electric contact means mounted in said housing in position for engagement and disengagement of said fixed contact means by said movable contact means, electrically conductive terminal means mounted in said housing, said movable contact means having an end pivotally engaging with and supported swingably on said terminal means, a movable insulation member, means permanently and pivotably affixing said movable contact means on said insulation member, said pivotal connection enabling movement thereabout of said movable contact means for self-adjustment of said movable contact means with respect to said terminal means and with respect to said fixed contact means, over-center switch-operating means movable between two positions and engaging said insulation member for causing engagement and disengagement of said movable and fixed contact means as said operating means is moved to and fro over-center.

3. A switch as claimed in claim 2 wherein said terminal means has two spaced parts, and said movable contact means extends between said parts and has extensions extending oppositely therefrom and engaging said parts for pivotally supporting said movable contact means.

4. A switch as claimed in claim 3 wherein said movable contact means comprises a resilient sheet metal stamping with a portion lanced therefrom in position to engage said insulation member as said fixed and movable contact means engage whereby said lanced portion enhances absorption by said movable contact means of kinetic energy incident to switch closing movement.

5. A switch as claimed in claim 2 in which said pivotal connecting means between said insulation member and said movable contact means is a single rivet.

6. A switch as claimed in claim 5 wherein said movable contact means comprises a resilient sheet metal stamping with a portion lanced therefrom in position to engage said insulation member as said fixed and movable contact means engage whereby said lanced portion enhances absorption by said movable contact means of kinetic energy incident to switch closing movement.

7. A switch as claimed in claim 2 wherein said movable contact means comprises a sheet metal stamping having extensions extending oppositely therefrom and said terminal means has two opposite parts with notches in which said extensions seat edgewise.

8. A switch as claimed in claim 7 wherein said movable contact means comprises a resilient sheet metal stamping with a portion lanced therefrom in position to engage said insulation member as said fixed and movable contact means engage whereby said lanced portion engages absorption by said movable contact means of kinetic energy incident to switch closing movement.

9. A switch as claimed in claim 7 in which said movable contact means is resilient and formed to disengage said fixed contact means after dead-center position of said over-center operating means is passed in movement from one switch position to another.

10. A switch as claimed in claim 9 in which said movable contact means are formed and mounted on said insulation member so as to engage said fixed contact means before said over-center means has moved completely into its new at-rest position when moving from one at-rest position to the other.

11. A switch as claimed in claim 2 wherein said movable contact means comprises a resilient sheet metal stamping with a portion lanced therefrom in position to engage said insulation member as said fixed and movable contact means engage whereby said lanced portion enhances absorption by said movable contact means on the kinetic energey incident to switch closing movement.

12. A switch as claimed in claim 2 in which said movable contact means comprises a resilient sheet metal stamping which is formed to disengage said fixed contact means after dead-center position of said over-center operating means is passed in movement from one switch position to another.

13. A switch as claimed in claim 12 in which said movable contact means is resilient and formed and mounted on said insulation member so as to engage said fixed contact means before said over-center means has moved completely into its new at-rest position when moving from one at-rest position to the other.

14. A switch as claimed in claim 2 in which said movable contact means is resilient and formed to disengage said fixed contact means after dead-center position of said over-center operating means is passed in movement from one switch position to another.

15. A switch as claimed in claim 14 in which said movable contact means is resilient and formed and mounted on said insulation member so as to engage said fixed contact means before said over-center means has moved completely into its new at-rest position when moving from one at-rest position to the other.

16. A switch as claimed in claim 2 wherein said insulation member has side arms connected by a transverse portion, and said movable contact means comprise a plurality of separate resilient electrically conductive members separately pivotally connected to said insulation member, and said terminal means comprises a plurality of separate members each swingably supporting one of said separate resilient members.

17. A switch as claimed in claim 16 wherein said separate resilient members are sheet metal stampings which are formed to disengage said fixed contact means after dead-center position of said over-center operating means is passed when moving from one switch position to another.

18. A switch as claimed in claim 17 wherein said movable contact means are formed and mounted so as to engage said fixed contact means before said over-center means has moved completely into its new at-rest position when moving from one at-rest position to the other.

19. A switch as claimed in claim 16 wherein the pivotal connection of said resilient members is adjacent the free ends of the arms of said insulation member, and the pivotal engagement of the contact means with said terminal members is also adjacent the free ends of said arms.

20. A switch as claimed in claim 16 wherein said resilient contact members each has oppositely projecting lateral extensions and said terminal members each has two opposite parts with notches in which said extensions seat edgewise.

21. A switch as claimed in claim 16 wherein each resilient contact member has a resilient portion lanced therefrom in position to engage said insulation member as said fixed and movable contact means engage and thereby to enhance absorption of energy by said movable contact means on switch closing movement.

22. A switch as claimed in claim 16 wherein each of said terminal means has two spaced parts, said resilient movable contact members each extending between said parts and having oppositely extending lateral extensions engaging said parts for pivotally supporting said movable contact means, and resilient means extending from said movable contact member in position to engage said insulating member as said movable and fixed contact member engage and thereby to enhance absorption of energy by said movable contact means on switch closing movement.

23. A switch as claimed in claim 2 wherein said insulation member has side arms connected by a transverse portion, and said housing has a protuberance providing in switch-open position a single point engagement by said transverse part at the center line of force application of said over-center means, thereby to maintain said movable contact means and insulation member in equilibrium in switch-open position.

24. A switch as claimed in claim 23 having a cover for said housing, said protuberance being on said cover, and means securing said cover on said housing in position to hold said terminal means in said housing.

* * * * *